United States Patent [19]

O'Connor

[11] Patent Number: 4,699,070

[45] Date of Patent: Oct. 13, 1987

[54] SECONDARY GRATE FOR ROTARY COMBUSTOR

[75] Inventor: Chadwell O'Connor, Newport Beach, Calif.

[73] Assignee: Westinghouse Electric Corp., Pittsburgh, Pa.

[21] Appl. No.: 942,568

[22] Filed: Dec. 15, 1986

[51] Int. Cl.[4] ..... F23G 5/04

[52] U.S. Cl. ..... 110/246; 432/77; 432/117; 432/118

[58] Field of Search ..... 432/103, 105, 107, 112, 432/113, 116, 117; 110/246

[56] References Cited

U.S. PATENT DOCUMENTS

| | | | |
|---|---|---|---|
| 3,822,651 | 7/1974 | Harris et al. | 110/246 |
| 4,014,642 | 3/1977 | Helming | 432/77 |
| 4,141,154 | 2/1979 | Buchner | 432/77 |
| 4,226,584 | 10/1980 | Ishikawa | 432/118 |

*Primary Examiner*—Henry C. Yuen

*Attorney, Agent, or Firm*—F. J. Baehr, Jr.

[57] ABSTRACT

In a combustor assembly having a main water cooled rotary combustor in which material is burned and which discharges into a furnace, a generally cylindrical secondary grate formed of water cooled pipes positioned in the furnace for receiving and holding material discharged from the main combustor so as to complete the burning while the secondary grate is slowly rotated to eventually discharge ashes and unburnable material from the furnace.

3 Claims, 3 Drawing Figures

SECONDARY GRATE FOR ROTARY COMBUSTOR

This invention relates generally to rotary kilns for burning waste, becoming known as rotary combustors, and more particularly concerns a secondary grate for such combustors.

U.S. Pat. No. 3,822,651, issued June 9, 1974, discloses an installation which has been determined to be particularly useful for burning MSW (municipal solid waste) and thereby generating useful steam. Burning takes place in a combustor drum consisting of a long cylindrical structure formed by water circulating pipes slowly rotating on the drum axis. The drum or cylinder is inclined at a slight angle so that material to be burned which is dumped in the higher end tumbles gradually toward the lower end. Air for burning is fed through holes formed between the pipes making up the cylindrical wall, with the air flow being controlled by ducts fitting adjacent the lower portions of the rotating combustor.

An advantage of such rotary combustors is that the MSW need not be classified, i.e., separated into different kinds of materials, since even large, non-burnable objects simply pass through the combustor and are disposed of with the ashes. Because of the wide variety of materials encountered, large burnable objects might well not have sufficient residence time in the combustor to completely burn, and it is therefore desirable to have some structure for holding burnable objects in the burning region after they have discharged from the combustor so that they can complete their burning.

An object of the invention is to provide a secondary grate for a rotary combustor which is as long-lasting and maintenance-free as the combustor itself.

Another object is to provide a secondary grate of the foregoing type which can be readily controlled to vary the residence or retention time of material being burned so as to meet the varying needs of the total system. A further object is to provide a grate as characterized above that positively discharges clinkers and non-burnable material so as to avoid clinkers and clogging the combustor or the secondary grate itself.

Other objects and advantages of the invention will become apparent upon reading the following detailed description and upon reference to the drawings, in which.

Figure 1:
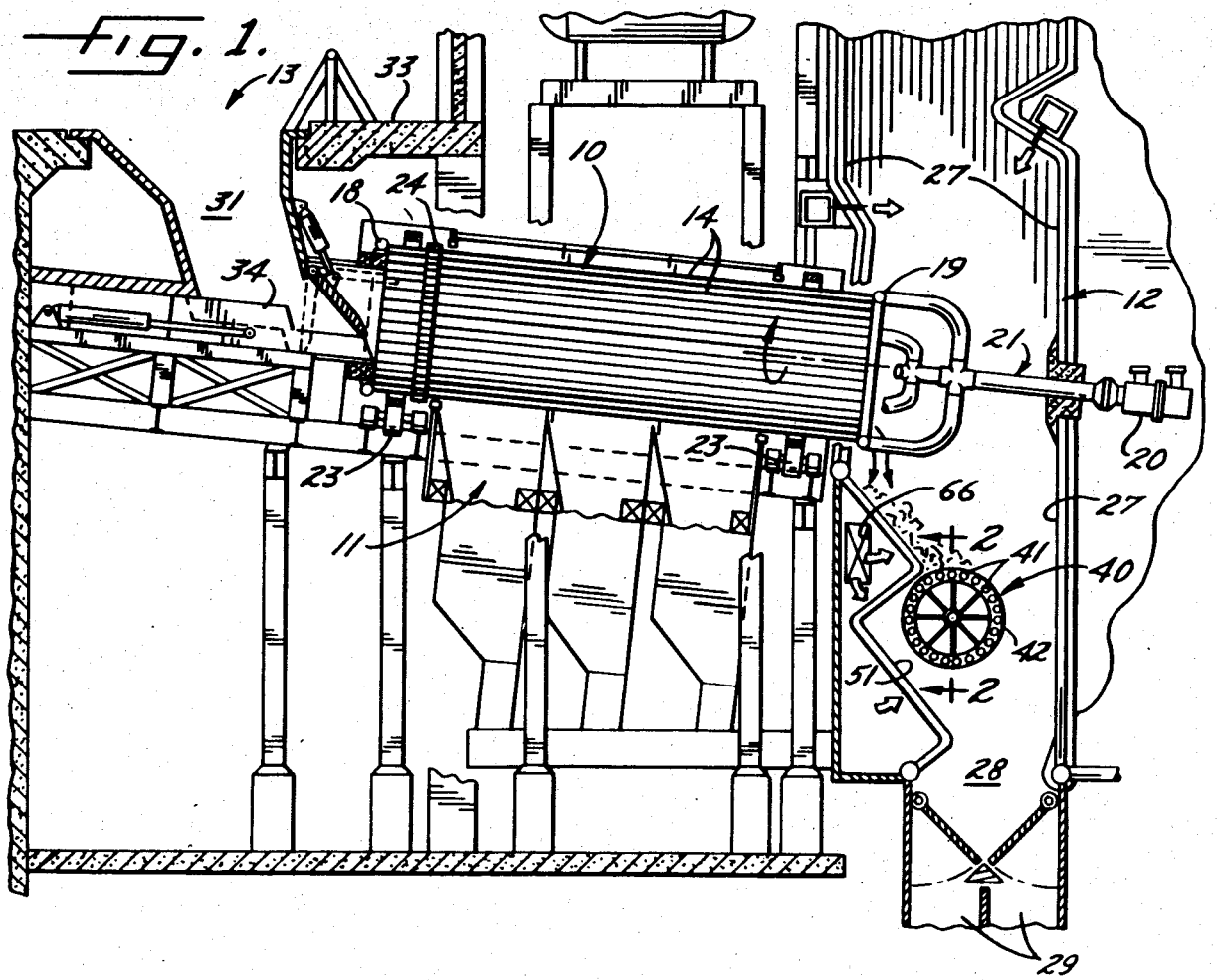
FIG. 1 is a fragmentary partially sectioned elevation of a rotary combustor assembly for burning MSW including a secondary grate embodying the invention.
Figure 2:
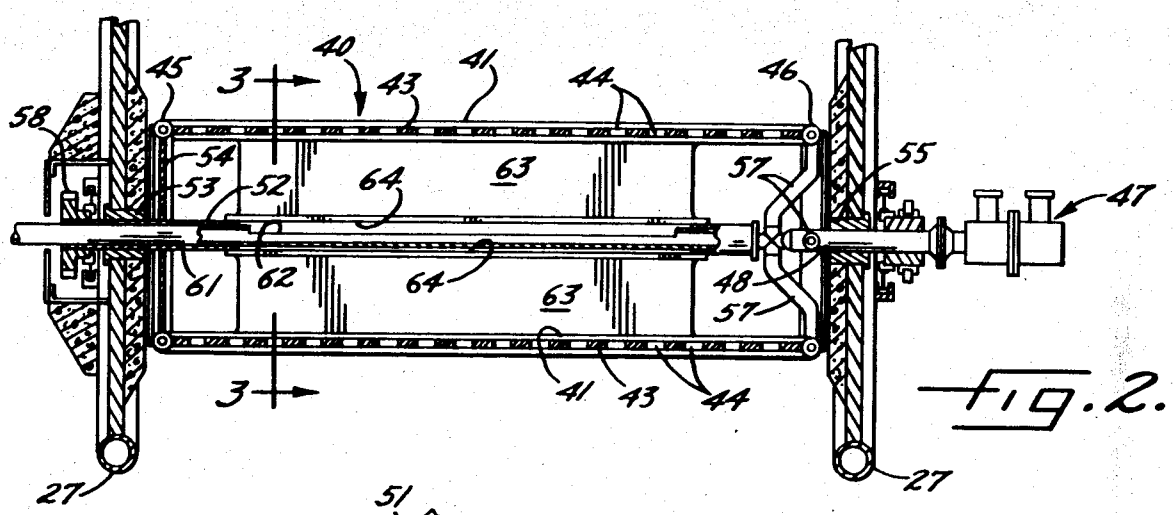
FIG. 2 is a fragmentary section taken approximately along the line 2—2 in FIG. 1.

While the invention will be described in connection with a preferred embodiment, it will be understood that I do not intend to limit the invention to that embodiment. On the contrary, I intend to cover all alternatives, modifications and equivalents included within the spirit and scope of the invention as defined by the appended claims.

Turning to the drawing, there is shown a structure for burning materials such as MSW and including a main rotary combustor 10 with a windbox 11 for delivering air to the combustor, a furnace 12, and an arrangement 13 for feeding combustible material into the combustor. The combustor 10 is formed of a plurality of water cooled pipes 14 joined together by perforated strips welded between the pipes to define a cylinder. The perforations in the strips between the pipes 14 run the length of the cylinder and make the cylinder gas porous.

The pipes 14 end in annular header pipes 18 and 19 at each end of the cylinder. A rotary joint 20 feeds water to, and removes steam and hot water from, the combustor 10 through concentric pipes 21. Water is directed to the header pipe 19, and thence to the combustor pipes 14, and steam and hot water from the header pipe 18 is carried back through certain ones of the combustor pipes 14 that do not carry input water and which communicate directly with the steam portion of the pipes 21.

The combustor 10 is mounted for rotation about the axis of the cylinder 16 on support rollers 23 with the axis being tilted so that the cylinder has a high end and a low end. The combustor is slowly rotated through a sprocket 24 in the direction of the arrow in FIG. 1.

The furnace 12 is defined by a plurality of boiler pipes 27 having a side opening for the combustor 10 and a bottom opening 28 leading to chutes 29 for ashes and non-burnable materials. The arrangement 13 for feeding combustible materials includes a chamber 31, beneath the level of a floor 33 from which material can be dumped. A reciprocating ram 34 feeds material into the upper open end of the combustor 10.

As observed above, a basic combustor is further disclosed in said U.S. Pat. No. 3,822,651, a waste feeding ram is disclosed in Ser. No. 000,510, filed Jan. 5,1987, and a windbox air flow control is disclosed in Ser. No. 942,570, filed Dec. 15,1986, all three of which disclosures are hereby specifically incorporated by reference.

In accordance with the invention, a secondary grate 40 formed by water cooled pipes 41 defining an outer cylindrical surface 42 is positioned in the furnace 12 to receive material discharged from the main combustor 10, combustion air is supplied through the cylindrical surface 42 to complete the burning of material from the combustor, and the grate 40 is slowly rotated to eventually drop ashes, clinkers and unburnable material into the furnace bottom opening 28. Preferably, the secondary grate 40 is a smaller, inside-out, version of the combustor 10, the pipes 41 being joined by perforated strips 43, having holes 44, welded between the pipes so that the cylinder surface 42 is gas porous.

The pipes 43 end in annular header pipes 45 and 46 at each end of the cylindrical surface 42. A rotary joint 47 feeds water to, and removes steam and hot water from, the grate 40 through concentric pipes 48. Water is directed to the header pipe 46, and thence to the grate pipes 41, and steam and hot water from the header pipe 45 is carried back through certain ones of the combustor pipes 41 that do not carry input water and which communicate directly with the steam portion of the pipes 48.

Cooperating with the secondary grate 40 to create a support for material discharged from the combustor 10 is a furnace interior wall formed of water pipes 51 which slopes to the cylindrical surface 42 and then folds to provide clearance for the lower body portion of the grate 40. Supporting the grate 40 is a sleeve 52 rotatably mounted in a bearing 53 and secured to a grate end wall 54, and a bearing 55 supporting the concentric pipes 48 at the opposite end of the grate. A short sleeve 56 is also fixed to the concentric pipes 48 and short radial pipes 57 connecting the concentric pipes 48 to the header 46.

Figure 3:
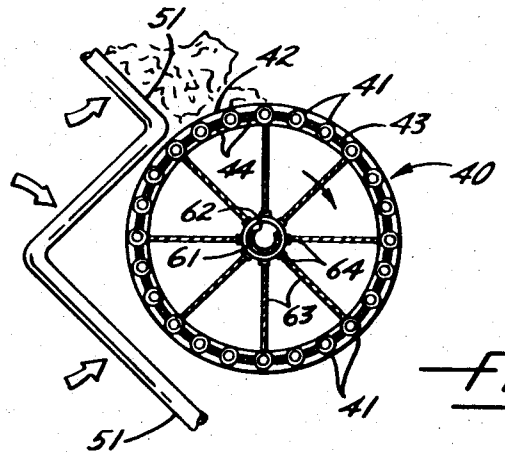
FIG. 3 is a fragmentary section taken approximately along the line 3—3 in FIG. 1.

The grate 40 is slowly rotated, in the direction of the arrow in FIG. 3, through a gear 58 on the sleeve 52 outside of the furnace wall.

Combustion air is supplied to the interior of the secondary grate 40 through a pipe 61 having a cutaway delivery port 62 and being fitted through the sleeve 52 with its end supported in the sleeve 56. The air is directed to the top surface of the grate 40, and confined to where the material being burned is concentrated, by radial vanes 63 secured to the inside of the pipes 41. The vanes 63 have inner lips 64 which are secured to the sleeves 52, 56 so as to hold the vanes in position. Air from the pipe port 62 is thus channeled up by the vanes 63 and guided through the openings 43 and into the material supported by the upper surface of the grate 40.

Those familiar with the art will appreciate that the grate 40 will possess the same longevity and maintenance-free characteristics exhibited by the main combustor 10 since it amounts to a smaller version of the same. The time that material which is still burning after being dumped from the combustor 10 remains in the furnace 12, so that burning can be completed, is easily controlled by simply varying the speed at which the grate 40 is rotated. Eventually, ashes, clinkers and nonburnable materials supported on the grate 40 will be rotated so as to fall from the cylindrical surface which eventually, being upside down, positively discharges such material into the furnace opening 28.

Combustion air is not only delivered through the pipe 61 to the underside of material supported by the secondary great 40 but combustion air is also supplied through a duct 66 to the underside of the pipes 51 so that material supported on this pipe wall is given an adequate supply of combustion air.

I claim as my invention:

1. A combustor assembly comprising, in combination, a plurality of water cooled pipes secured together to define an inner generally cylindrical surface and mounted for rotation about the axis of said surface, said pipes being secured together so as to define a plurality of intermediate openings so that said cylindrical surface is gas porous, said axis being tilted so that the cylindrical surface has a high end and a low end, means for feeding material to be burned into said high end of said surface, means for feeding air through said gas porous surface so as to burn said material, a plurality of water cooled pipes secured together to define a secondary grate having an outer generally cylindrical surface and mounted for rotation about the axis of said outer surface, said outer surface being positioned to receive material discharged from the lower end of said inner cylindrical surface, means for delivering air through said outer cylindrical surface to burn material resting on the outer surface, and means for rotating said outer cylindrical surface.

2. The combination of claim 1 including a furnace having a side opening and a bottom opening, said low end of the cylindrical surface extending thorugh said furnace side opening, and said secondary grate being mounted in said furnace so that said rotation of the outer cylindrical surface drops unburned material into said furnace bottom opening.

3. The combination of claim 2 in which said furnace has an interior wall adjacent said secondary grate for creating, with said grate, support for burning material in said furnace.

* * * * *